United States Patent [19]

Kakizaki et al.

[11] Patent Number: 4,910,429

[45] Date of Patent: Mar. 20, 1990

[54] CATHODE RAY TUBE WHICH IS SMALL AND USES A SMALL AMOUNT OF POWER

[75] Inventors: Takehiro Kakizaki; Shoji Araki, both of Kanagawa, Japan

[73] Assignee: Sony Corporation, Tokyo, Japan

[21] Appl. No.: 643,545

[22] Filed: Aug. 23, 1984

[30] Foreign Application Priority Data

Aug. 26, 1983 [JP] Japan ..... 58-156167

[51] Int. Cl.[4] ..... H01J 29/62; H01J 31/38

[52] U.S. Cl. ..... 313/389; 313/450

[58] Field of Search ..... 313/384, 389, 390, 414, 313/432, 434, 421, 449, 450, 458, 460, 479

[56] References Cited

U.S. PATENT DOCUMENTS 2,681,426 6/1954 Schlesinger ..... 313/432 X 3,731,136 5/1973 Roussin ..... 313/434 X

FOREIGN PATENT DOCUMENTS 121662 9/1979 Japan ..... 313/479

*Primary Examiner*—Kenneth Wieder

*Attorney, Agent, or Firm*—Hill, Van Santen, Steadman & Simpson

[57] ABSTRACT

A cathode ray tube comprises an envelope; an electron beam source positioned at one end of the envelope; a target positioned at another end of the envelope opposite to the electron beam source; a mesh electrode positioned opposite to the target; and an electrostatic lens means positioned between the electron beam source and the mesh electrode, the lens means having a first electrode, a second electrode and a third electrode respectively positioned along the electron beam path to focus the electron beam, the second electrode being divided into four arrow or zig-zag patterns to deflect the electron beam.

1 Claim, 4 Drawing Sheets

CATHODE RAY TUBE WHICH IS SMALL AND USES A SMALL AMOUNT OF POWER

BACKGROUND OF THE INVENTION

1. Field of the Invention

The present invention relates to a cathode ray tube which is suitably applied to an image pick-up tube of electrostatic focus/electrostatic deflection type for example.

2. Description of the Prior Art

Image pick-up tubes of magnetic focus/magnetic deflection type or electrostatic focus/magnetic deflection type are known in the prior art. In these image pick-up tubes in usual, good characteristics can be obtained when the tube length is long. However, if the image pick-up tube is used in a video camera of small size for example, the tube length is preferably short, because the video camera as a whole may be made compact.

When the image pick-up tube is used in the video camera of small size, the power consumption is preferably little.

SUMMARY OF THE INVENTION

In view of above-mentioned circumstances, an object of the present invention is to provide a cathode ray tube which is compact and light-weight and has little power consumption without deteriorating the characteristics.

In order to attain the object, a cathode ray tube of the invention comprises an envelope; an electron beam source positioned at one end of the envelope; a target positioned at another end of the envelope opposite to the electron beam source; a mesh electrode positioned opposite to the target; and an electrostatic lens means positioned between the electron beam source and the mesh electrode, the lens means having a first electrode, a second electrode and a third electrode respectively positioned along the electron beam path to focus the electron beam, the second electrode being divided into four arrow or zig-zag patterns to deflect the electron beam.

DESCRIPTION OF THE PREFERRED EMBODIMENTS

Figure 1:
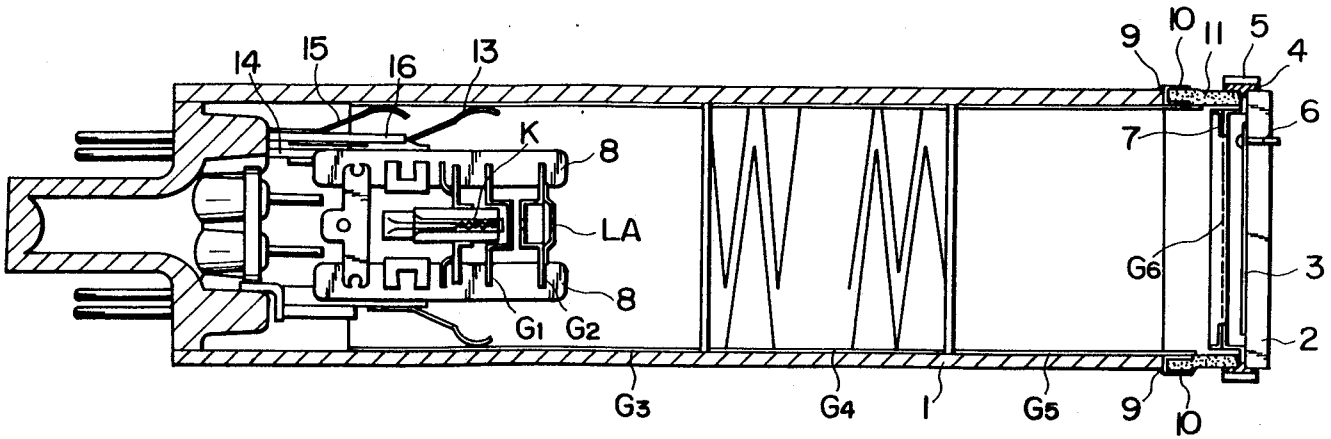
FIG. 1 is a sectional view of a cathode ray tube as an embodiment of the invention.

An embodiment of the invention will now be described referring to FIG. 1. The embodiment is an example of application of the invention to an image pick-up tube of electrostatic focus/electrostatic deflection type (S.S type).

In the FIGURE, reference numeral 1 designates a glass bulb, numeral 2 a face plate, numeral 3 a target screen (photoconductor screen), numeral 4 indium for cold sealing, and numeral 5 a metal ring. On the target screen 3 is impressed bias voltage, say +50V. Numeral 6 designates a pin electrode for signal taking, which penetrates the face plate 2 and contacts with the target screen 3. $G_6$ designates a mesh electrode mounted on a mesh holder 7. The mesh electrode $G_6$ is connected through the mesh holder 7 and the indium 4 to the metal ring 5. Prescribed voltage, say +950V, is impressed to the mesh electrode $G_6$ through the metal ring 5.

In FIG. 1, K, $G_1$ and $G_2$ designate respectively a cathode, a first grid electrode and a second electrode, all constituting an electron gun. The $G_1$ electrode and the $G_2$ electrode are supplied with voltage, say +4 V and +320 V, respectively. Numeral 8 designates a bead glass to fix these electrodes. LA designates a beam limiting aperture.

In FIG. 1, $G_3$, $G_4$ and $G_5$ designate respectively a third grid electrode, a fourth grid electrode and a fifth grid electrode, corresponding to the first, second and third cylindrical electrodes in the invention. These electrodes are made in a process that metal such as chromium or aluminum is evaporated or plated on inner surface of the glass bulb 1 and then prescribed patterns are formed by means of laser cutting or photo etching. In the invention, focusing electrodes system is constituted by the electrodes $G_3$, $G_4$ and $G_5$, and the electrode $G_4$ serves also as deflection electrode.

The electrode $G_5$ is connected to a conducting layer 10 formed on a surface of a ceramic ring 11 which is frit-sealed 9 to an end of the glass bulb 1. The conducting layer 10 is formed by sintering Ag paste, for example. Prescribed voltage, say +500 V, is impressed to the electrode $G_5$ through the ceramic ring 11.

Figure 2:
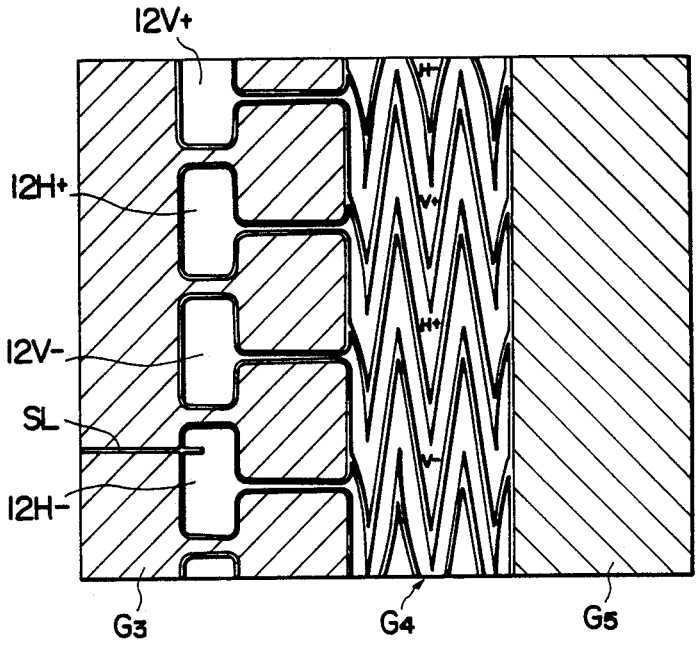
FIG. 2 is a development of the electrodes $G_3$, $G_4$, $G_5$ in FIG. 1.

In FIG. 1, the electrodes $G_3$, $G_4$ and $G_5$ are formed as shown in a development of FIG. 2. That is, the electrode $G_4$ is made patterns where four electrodes $H_+$, $H_-$, $V_+$, $V_-$ are insulated and interleaved and alternately arranged (arrow or zig-zag patterns). Leads ($12H_+$), ($12H_-$), ($12V+$) and ($12V_-$) from these electrodes $H_+$, $H_-$, $V_+$, $V_-$ are also formed on inner surface of the glass bulb 1 simultaneously to the formation of the electrodes. The leads ($12H_+$), ($12H_-$), ($12V_+$) and ($12V-$) are insulated from the electrodes $G_3$ and cross it. In FIG. 2, SL designates a slit to prevent the $G_3$ electrode from being heated when the electrodes $G_1$ and $G_2$ are heated from outside of the tube for evacuation.

In FIG. 1, numeral 13 designates a contactor spring with one end connected to a stem pin 14, and other end of the spring 13 is contacted with the leads ($12H_+$), ($12H_-$), ($12V_+$) and ($12V_-$). The spring and the stem pin are provided to each of the leads ($12H_+$), ($12H_{31}$), ($12V_+$) and ($12V_-$). The electrodes $H_+$ and $H_-$ to constitute the electrode $G_4$ are supplied through the stem pin, the spring and the leads ($12H_+$), ($12H_-$), with prescribed voltage, for example, horizontal deflection voltage which varies from the center voltage, +13 V, symmetrically within range between +50 V and −50V. The electrodes $V_+$ and $V_-$ are also supplied through the stem pin, the spring and the leads ($12V+$), ($12V-$) with prescribed voltage, for example, vertical deflection voltage which varies from the center voltage, +13 V, within range between +50 V and −50 V.

Further in FIG. 1, numeral 15 designates a contactor spring with one end connected to a stem pin 16, and other end of the spring 15 is connected to the electrode $G_3$. Prescribed voltage, say +500 V, is impressed to the electrode $G_3$ through the stem pin 16 and the spring 15.

Figure 3:
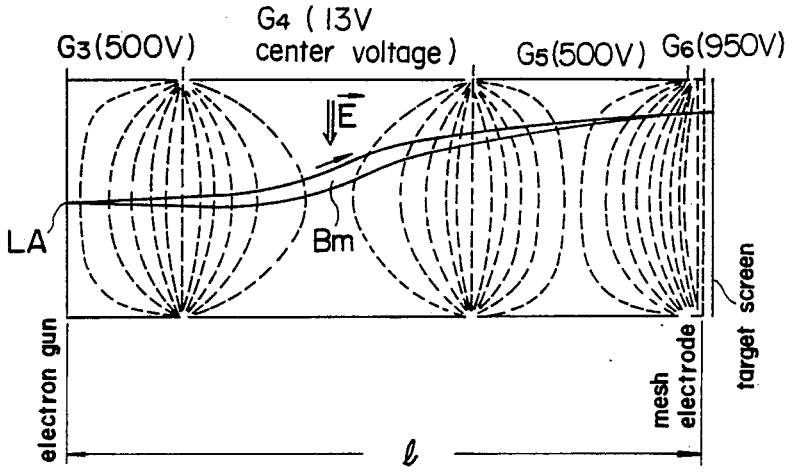
FIG. 3 is a diagram illustrating equipotential surface of electrostatic lenses formed by the cathode ray tube in the embodiment.

In FIG. 3, broken line shows equipotential surface of electrostatic lenses formed by the electrodes $G_3$–$G_6$, and focusing of electron beam $B_m$ is performed by the electrostatic lenses. The electrostatic lens formed between the electrodes $G_5$ and $G_6$ corrects the landing error. The equipotential surface shown by broken line in FIG. 3 excludes deflection electric field E by the electrode $G_4$.

Deflection of the electron beam $B_m$ is performed by the electric field E of the electrode $G_4$.

Although electrostatic focus is performed by the three electrodes $G_3$, $G_4$, $G_5$ in the above example, the number of electrodes is not restricted to this.

In S.S type as shown in FIG. 1, the tube length may be shortened without producing any trouble in comparison to others.

In electrostatic focus/magnetic deflection type (S.M type) and magnetic focus/magnetic deflection type (M.M type), for example, deflection is performed by magnetic field. If electron is deflected by magnetic field, kinetic energy of the electron does not vary but velocity component in the axial direction decreases during the deflection, resulting in a curvature of the image field, thereby defocus occurs at peripheral portion of the target screen. The defocus is corrected usually by dynamic focus, but if the tube length is shortened the deflection angle increases and the curvature of the image field also increases thereby the correction is more required. In magnetic deflection, the deflection center varies depending on the deflection amount, and if the tube length is shortened the deflection angle increases and variation of the deflection center also increases. If the landing error is corrected by the collimation lens in this state, the landing angle characteristics will be deteriorated. Further in the S.M type and M.M type, the deflection power is approximately proportional to $1/(\text{tube length})_2$ and therefore if the tube length is shortened the power consumption required for the deflection will increase drastically.

On the contrary, in the magnetic focus/electrostatic deflection type (M.S type) and the electrostatic focus/electrostatic deflection type (S.S type), deflection is performed by electric field and therefore if the tube length is shortened above-mentioned trouble will not be produced as done in the magnetic deflection.

Further in the M.M type and M.S type, the focusing power is proportional to $1/(\text{tube length})_2$ and therefore if the tube length is shortened the power consumption required for the focusing will increase drastically.

Consequently, only in S.S type, the tube length may be shortened without producing any trouble in principle.

The inventors in the present patent application further studied the S.S type, and as a result obtained the conclusion that unless the tube length is shortened to some extent the characteristics will be deteriorated.

This will be explained referring to FIG. 4.

Parameters to determine characteristics of the S.S type are length x of the $G_4$ electrode (deflection electrode), distance y between the beam limiting aperture LA and the center of the $G_4$ electrode, and the tube length l (distance between the beam limiting aperture LA and the mesh electrode $G_6$).

Figure 4A:
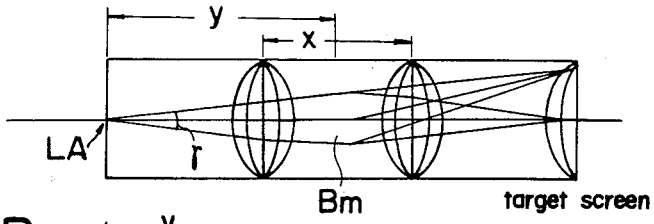
FIG. 4A and 4B are diagrams illustrating lens action of the invention.
Figure 4B:
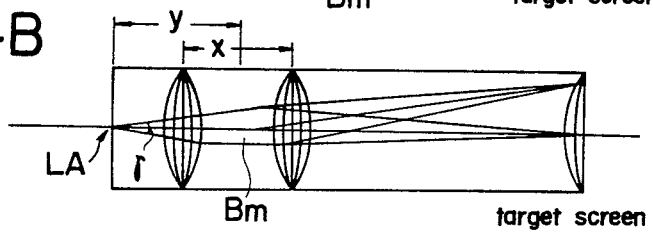

If the tube length l is long, when the electron beam $B_m$ is entered into the electrostatic lens as shown in FIG. 4A, the diameter of the beam is enlarged by the divergence angle $\gamma$, and therefore the electron beam aberration at focusing onto the target screen increases on account of the lens aberration. In order to improve this, the electron beam $B_m$ must be entered into the electrostatic lens before diverged much. For example, the distance y is decreased as shown in FIG. 4B. In this case, however, the center of the electrostatic lens is shifted to side of the beam limiting aperture LA and the magnification becomes large (e.g. 2.0 or more), and therefore diameter of the beam limiting aperture LA must be decreased and this is not preferable from the viewpoint of manufacturing.

On the contrary, if the tube length l is short, the electron beam $B_m$ is entered into the electrostatic lens before diverged much thereby the aberration is suppressed.

However, if the tube length l is made too short, since the deflection angle becomes large the landing error must be corrected by increasing the magnitude of collimation thereby aberration based on distortion of the collimation lens increases.

Consequently, in the S.S type, unless the tube length is shortened to some extent the characteristics will be deteriorated.

Figure 5:
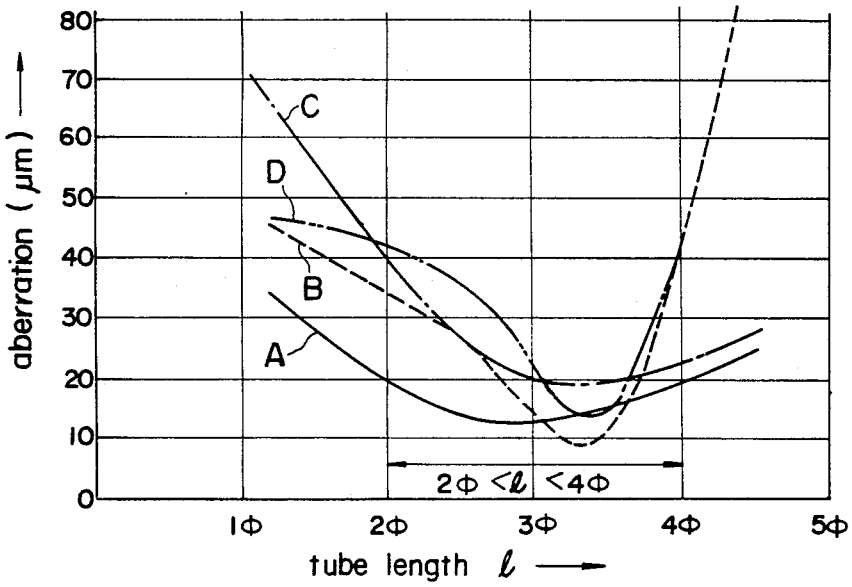
FIG. 5 is a graph illustrating relation between the beam aberration and the tube length.

FIG. 5 shows aberration characteristics when the tube length l is varied at prescribed values of x, y, wherein $\phi$ is the tube diameter. In the FIGURE, solid line A, broken line B, dash-and-dot line C and dash-and-two dots line D show aberration characteristics in ($x=\frac{1}{3}l-1/10l$, $y=\frac{1}{2}L-1/10l$), ($x=\frac{1}{3}(+1/10l$, $y=\frac{1}{2}l-1/10l$), ($x=\frac{1}{3}l-1/10l$, $y=\frac{1}{2}l$) and ($x=\frac{1}{3}l+1/10l$, $y=\frac{1}{2}l$) respectively.

It is seen from FIG. 5 that the tube length l is preferably $2\phi$ to $4\phi$ in the S.S type.

On the contrary to the S.S type as above described, the practicable and existing M.M type has $l=4\phi$ or more and the S.M type has $l=4\phi$ to $5\phi$. The M.S type may have $l=3\phi$ but the power for the focusing cannot be ignored then. Consequently, in order to minimize the power consumption without deteriorating the characteristics, the tube length can be most shortened by adopting the S.S type.

Accordingly, in the constitution of S.S type as shown in FIG. 1, the tube length l may be shortened without deteriorating the characteristics, and the deflection coil and the focusing coil are unnecessary and the cathode ray tube being compact and light-weight is obtained. Moreover, since deflection and focusing are performed electrostatically, little power consumption is required.

In the embodiment of FIG. 1, metal is adhered in patterns onto inner surface of the glass bulb thereby the electrodes are formed. Consequently, diameter of the collimation lens may be made approximately as large as the inner diameter of the glass bulb. If the tube length is shortened, the deflection angle increases thereby the collimation lens must be strengthened. However, since the diameter of the collimation lens may be made large as above described, even if the collimation lens is strengthened, the aberration will not increase and the landing angle characteristics not be deteriorated.

Figure 6:
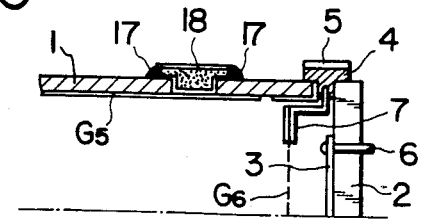
FIG. 6 is a sectional view of main part of another embodiment of the invention.

In order to impress voltage to the electrode $G_5$, as shown in another embodiment of FIG. 6, a ceramic ring 18 with surface coated by a conductive layer such as Ag paste or the like may be frit-sealed 17 at midway of the glass bulb 1 opposite to the $G_5$ electrode and voltage be impressed through the ceramic ring 18. Although not shown in the FIGURE, a hole may be bored through the glass bulb 1 opposite to the $G_5$ electrode and a metal pin may be soldered or a conductive frit be installed so as to impress voltage through the metal pin or the conductive frit to the electrode $G_5$.

Although the above embodiments disclose application of the invention to the image pick-up tube of S.S type, the invention is not restricted to this but can be applied also to the cathode ray tube such as storage tube, scan converter tube, or the like.

According to the invention as above described, since the cathode ray tube is constituted in S.S type, the tube length l may be shortened without deteriorating the characteristics and further the deflection coil and the focusing coil are unnecessary thereby the cathode ray tube being compact and light-weight can be obtained. Moreover, since deflection and focusing are performed electrostatically, little power consumption is required.

What is claimed is:

1. A cathode ray tube comprising:

(a) an envelope;

(b) an electron beam source positioned at one end of said envelope;

(c) a target positioned at another end of said envelope opposite to said electron beam source;

(d) a mesh electrode positioned opposite to said target; and (e) an electrode lens means positioned between said electron beam source and said mesh electrode, said lens means having a first electrode, a second electrode and a third electrode respectively positioned along said electron beam path to focus said electron beam, said second electrode being divided into four arrow or zig-zag patterns to deflect said electron beam, and wherein the length between said electron beam source and said mesh electrode is in the range $2\phi$ to $4\phi$ where $\phi$ is the inner diameter of said first, second and third electrodes.

* * * * *